US012507821B1

(12) United States Patent
Xiang et al.

(10) Patent No.: US 12,507,821 B1
(45) Date of Patent: Dec. 30, 2025

(54) CARPET

(71) Applicant: FLEXISPOT, INC., Irvine, CA (US)

(72) Inventors: Lehong Xiang, Ningbo (CN); Haoyu Ye, Ningbo (CN); Shuang Zhao, Ningbo (CN)

(73) Assignee: FLEXISPOT, INC., Irvine, CA (US)

( * ) Notice: Subject to any disclaimer, the term of this patent is extended or adjusted under 35 U.S.C. 154(b) by 0 days.

(21) Appl. No.: 19/059,320

(22) Filed: Feb. 21, 2025

(30) Foreign Application Priority Data

Aug. 27, 2024 (CN) ..... 202422089272.5

(51) Int. Cl.
*A47G 27/02* (2006.01)
*A47G 27/04* (2006.01)

(52) U.S. Cl.
CPC ..... *A47G 27/0243* (2013.01); *A47G 27/0412* (2013.01)

(58) Field of Classification Search
CPC ..... A47G 27/04; A47G 27/00; D06N 7/00
See application file for complete search history.

(56) References Cited

U.S. PATENT DOCUMENTS

| | | | | |
|---|---|---|---|---|
| 9,695,601 | B2 * | 7/2017 | Whispell | E04F 15/02005 |
| 9,696,601 | B2 * | 7/2017 | Hong | G02F 1/13452 |
| 2013/0055665 | A1 * | 3/2013 | Qiong | E04F 15/02172 52/177 |
| 2016/0037949 | A1 | 2/2016 | Dawson et al. | |

FOREIGN PATENT DOCUMENTS

| | | | | |
|---|---|---|---|---|
| CN | 205125846 U | * | 4/2016 | A47G 27/02 |
| CN | 213155291 U | | 5/2021 | |
| CN | 215243342 U | | 12/2021 | |
| CN | 215538076 U | * | 1/2022 | A63B 6/00 |
| CN | 218484285 U | | 2/2023 | |
| EP | 1733920 A1 | | 12/2006 | |

* cited by examiner

*Primary Examiner* — Lynda Salvatore
(74) *Attorney, Agent, or Firm* — Bayramoglu Law Offices LLC

(57) ABSTRACT

A carpet is provided. The carpet includes a pad layer and a carpet layer laid on the pad layer, where the carpet is machine washable, and further includes a connection module; the connection module is located below the carpet layer and connected to the carpet layer; and when the carpet layer or the pad layer is displaced or tends to be displaced due to external force, the connection module and the pad layer are in close proximity to and against each other. The carpet achieves convenient and quick alignment between the carpet layer and the pad layer, and effectively avoids the carpet layer from detaching or deviating from the pad layer during use.

23 Claims, 24 Drawing Sheets

CARPET

CROSS-REFERENCE TO THE RELATED APPLICATIONS

This application is based upon and claims priority to Chinese Patent Application No. 202422089272.5, filed on Aug. 27, 2024, the entire contents of which are incorporated herein by reference.

TECHNICAL FIELD

The present disclosure relates to the technical field of household textiles, and in particular to a carpet.

BACKGROUND

As a single-layer composite structure with an anti-slip layer at the bottom, a traditional carpet is generally in one-piece form with a large area, and cannot be machine washed, making it very difficult for the user's daily use and maintenance. After prolonged use, the carpet may accumulate dust and be difficult to clean. Meanwhile, due to the difficulty in cleaning the carpet after prolonged use, the carpet may adsorb stains, resulting in the production of odors and posing a threat to human health. In view of this, machine washable carpets are emerging on the market, making the cleaning of carpets easy. The carpets in related art, such as the easy-to-clean and detachable household carpet disclosed in Chinese patent application CN218484285U, are double-layer structures, including a pad layer and a carpet layer. The pad layer is anti-slip and laid on the ground. The shape of the carpet layer matches that of the pad layer and is placed on top of the pad layer. The carpet layer and the pad layer are fixed through hook&loop fasteners, etc.

Although the above-mentioned double-layer carpets in the related art solve the problem of difficulty in carpet cleaning, there are still the following defects in actual use. Firstly, after cleaning and drying, the corner or edge of the double-layer carpet is prone to warping, wrinkling, etc. Consequently, when the carpet is re-laid on the pad, it is difficult to align the carpet with the pad. Due to the difficulty in aligning the carpet with the pad, it will take a long time to lay the carpet, thereby affecting the use of the carpet. Secondly, after multiple uses or cleanings of the carpet, the hook&loop fasteners are prone to damage, and their adhesive performance may degrade, resulting in weak fixation between the carpet layer and the pad layer. Therefore, when someone is walking on the carpet, the carpet layer is easily detached from the pad layer under the action of friction.

SUMMARY

A technical problem to be solved by the present disclosure is to overcome the above-mentioned defects of the related art. To this end, the present disclosure provides a carpet that achieves convenient and quick alignment between a carpet layer and a pad layer and effectively avoids the carpet layer from detaching or deviating from the pad layer during use.

A technical solution provided in the present disclosure is a carpet with a following structure, including:

a pad layer, laid on a floor;

a carpet layer, laid on the pad layer; and connection modules, located below the carpet layer and connected to the carpet layer, where when the carpet layer or the pad layer is displaced or tends to be displaced due to external force, the connection module and the pad layer are in close proximity to and against each other.

In some embodiments, the pad layer is provided with limiting holes that penetrate upper and lower surfaces of the pad layer; and the connection module is accommodated in the limiting hole.

In some embodiments, there is a movement gap between the connection module and an inner wall of the limiting hole.

In some embodiments, there are multiple connection modules, and there are multiple limiting holes provided at an edge of the pad layer; and the limiting holes are configured to accommodate the connection modules, respectively.

In some embodiments, at least one connection module accommodated in the limiting hole is located at a corner of a bottom of the carpet layer.

In some embodiments, at least one of the connection modules is located at an edge of a bottom of the carpet layer and on an outer side of the pad layer.

In some embodiments, there are multiple connection modules; and the multiple connection modules are arranged at an edge of a bottom of the carpet layer and on an outer side of the pad layer.

In some embodiments, the connection module is detachably connected to the floor; and the detachable connection is one of adhesive connection, vacuum adsorption connection, electrostatic adsorption connection, magnetic attraction connection, binding connection, concave-convex combination, and buckle connection.

In some embodiments, a lower end of the connection module is provided with an adhesive flexible glue layer that adheres to the floor; alternatively, the connection module is made of an adhesive flexible glue material; and alternatively, the connection module is made of an adhesive material and adheres to the floor after absorbing water.

In some embodiments, the connection module is a suction cup connected to the carpet layer and vacuum adsorbed to the floor; alternatively, the connection module is a connection plate connected to the carpet layer and connected to a suction cup that is vacuum adsorbed to the floor; and alternatively, a lower end surface of the connection module is provided with an adsorbing part made of an adsorbable material.

In some embodiments, the connection module is a connection element connected to the carpet layer; and the connection element is connected to an electrostatic sticker electrostatically adsorbed to the floor.

In some embodiments, the connection module includes a first magnetic plate connected to the carpet layer and a second magnetic plate connected to the floor; and the first magnetic plate and the second magnetic plate form a magnetic attraction connection.

In some embodiments, the connection module includes a positioning element detachably connected to the floor and a rope connected to the carpet layer; and the rope is connected to the positioning element.

In some embodiments, the connection module includes a first positioning member connected to the floor and a second positioning member connected to the carpet layer; and the first positioning member and the second positioning member are combined through a concave-convex structure.

In some embodiments, the connection module includes a first buckle connected to the floor and a second buckle connected to the carpet layer; and the first buckle and the second buckle match and form an insertion connection.

In some embodiments, the connection module is detachably connected to the carpet layer.

In some embodiments, an upper end surface of the connection module is provided with a hook&loop fastener surface, and a fabric surface layer matching and adhering to the hook&loop fastener surface is provided at a bottom surface of the carpet layer; alternatively the upper end surface of the connection module is provided with a fabric surface layer, and a hook&loop fastener surface matching and adhering to the fabric surface layer is provided at the bottom surface of the carpet layer; alternatively the upper end surface of the connection module is provided with an adhesive flexible glue layer, and the adhesive flexible glue layer matches and adheres to the bottom surface of the carpet layer; and alternatively the bottom surface of the carpet layer is provided with an adhesive flexible glue layer corresponding to the connection module; and the adhesive flexible glue layer matches and adheres to the upper end surface of the connection module.

In some embodiments, the pad layer includes a base layer, a first anti-slip layer located below the base layer, and a second anti-slip layer located above the base layer; and the base layer, the first anti-slip layer, and the second anti-slip layer are combined together to form the pad layer.

In some embodiments, the second anti-slip layer includes multiple anti-slip protrusions evenly distributed on the base layer.

In some embodiments, the pad layer is a one-piece pad; and alternatively the pad layer includes multiple pad units; the multiple pad units are spliced together to form the pad layer; the pad units are polygonal; a surrounding edge of the pad unit is provided with multiple spaced clamping protrusions; and a clamping groove for adaptively clamping the clamping protrusion of another pad unit is provided between each two adjacent clamping protrusions.

Overall, compared with the prior art, the carpet provided in the present disclosure has the following advantages.

Firstly, the carpet layer of the carpet is laid on the pad layer, and there is no connection between the carpet layer and the pad layer, such that the carpet layer can be disassembled separately. That is, the carpet layer can be removed separately for machine washing, which is convenient for cleaning the carpet layer. Furthermore, the carpet is divided into the carpet layer and the pad layer that are detachable, effectively reducing the thickness of the carpet layer and facilitating machine washing.

Secondly, the carpet further includes the connection module that is connected to the carpet layer. To lay the carpet, the pad layer is first laid, then the connection module is connected to the carpet layer, and the carpet layer is laid. The connection module connected below the carpet layer is configured to prevent a horizontal displacement between the carpet layer and the pad layer. That is, due to the mutual limit of the connection module and the pad layer, the carpet layer is prevented from displacing horizontally relative to the pad layer. Furthermore, the limit of the carpet layer and the connection module effectively prevents the horizontal displacement of the pad layer relative to the carpet layer. Therefore, the carpet can prevent the horizontal displacement of the carpet layer and the pad layer, thereby ensuring accurate, simple, and convenient alignment between the carpet layer and the pad layer during carpet laying.

Thirdly, the connection module is connected to the carpet layer, and the connection module has a certain degree of hardness and weight. In this way, it can effectively prevent the edge of the carpet layer from warping, wrinkling, etc., and improve the laying efficiency. In addition, due to the mutual limit of the connection module and the pad layer, the horizontal movement of the carpet layer is restricted, effectively avoiding the horizontal displacement of the carpet layer due to force, and preventing the carpet layer from detaching or deviating from the pad layer.

Another technical solution provided in the present disclosure is a carpet with a following structure, including:

a pad layer, laid on a floor;

a carpet layer, laid on the pad layer; and a connection module, located below the carpet layer, where the connection module includes an upper surface connected to the carpet layer and a lower surface detachably connected to the floor.

Compared with the prior art, the carpet provided in the present disclosure has the following advantages. The carpet is provided with the connection module and the lower surface of each of the connection module is detachably connected to the floor, such that the carpet layer is fixed relative to the position of the floor. The design can effectively prevent the edge of the carpet layer from warping, wrinkling, etc., thereby improving the laying efficiency. In addition, due to the mutual limit of the connection module and the pad layer, the horizontal displacement of the carpet layer and the pad layer is prevented. Thus, when the carpet is laid, the carpet layer and the pad layer can be aligned accurately, and the alignment operation is simple and convenient. Besides, due to the mutual limit of the connection module and the pad layer, the horizontal movement of the carpet layer is further restricted, effectively avoiding horizontal displacement of the carpet layer due to force, and preventing the carpet layer from detaching or deviating from the pad layer.

Another technical solution provided in the present disclosure is a carpet with a following structure, including:

a pad layer, laid on a floor;

a carpet layer, laid on the pad layer; and a connection module, located below the carpet layer, where the connection module includes an upper surface connected to the carpet layer and a lower surface being an anti-slip surface to increase friction between the connection module and the floor.

Compared with the prior art, the carpet provided in the present disclosure has the following advantages. In the carpet, the lower surface of the connection module is not connected to the floor and it undergoes anti-slip treatment to increase the fiction between the connection module and the floor. Thus, the carpet layer is fixed relative to the position of the floor, thereby preventing the carpet layer from being displaced and avoiding the carpet layer from detaching or deviating from the pad layer. In addition, in the carpet, the design of the connection module can effectively prevent the edge of the carpet layer from warping, wrinkling, etc., thereby improving the laying efficiency. Due to the mutual limit of the connection module and the pad layer, the horizontal displacement of the carpet layer and the pad layer is prevented. Thus, when the carpet is laid, the carpet layer and the pad layer can be aligned accurately, and the alignment operation is simple and convenient.

REFERENCE NUMERALS

Figure 1:
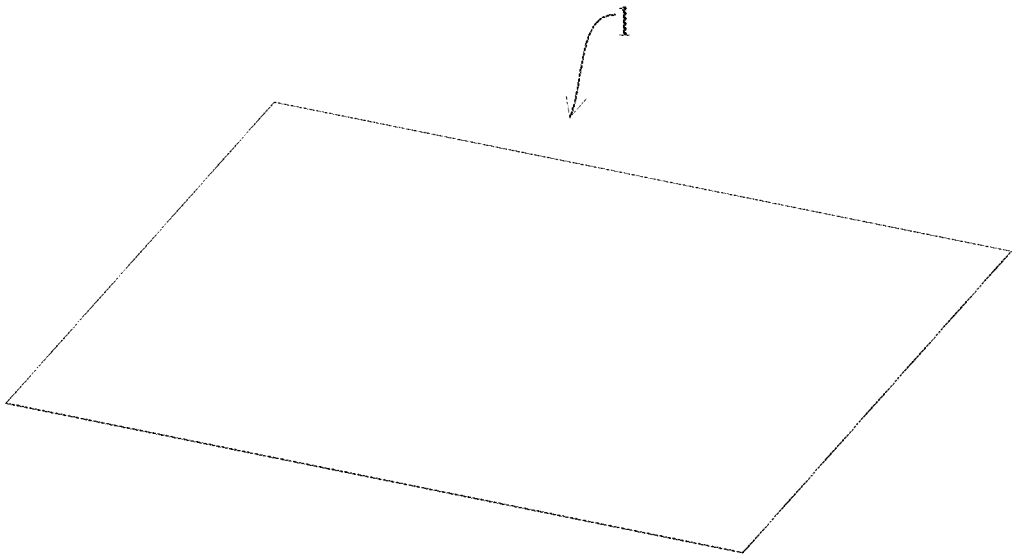
FIG. 1 is a front structural schematic diagram of a carpet according to some implementations of the present disclosure.

1. carpet layer; 2. pad layer; 200. pad unit; 201. limiting hole; 202. clamping protrusion; 203. clamping groove; 204. anti-slip protrusion; 205. base layer; 206. first anti-slip layer; 207. second anti-slip layer; 3. connection module; 300. hook&loop fastener surface; 301. first adhesive flexible glue layer; 302. second adhesive flexible glue layer; 303. connection plate; 304. suction cup; 305. positioning element; 3050. first plate; 3051. second plate; 3052. third plate; 3053. connection groove; 306. rope; 307. first positioning member; 3070. groove; 308. second positioning member; 309. connection element; 310. electrostatic sticker; 311. first buckle; 312. second buckle; 313. first magnetic plate; and 314. second magnetic plate.

DETAILED DESCRIPTION OF THE EMBODIMENTS

Firstly, those skilled in the art should understand that the implementations herein are merely intended to explain the technical principles of the embodiments in the present disclosure, rather than to limit the protection scope of the embodiments in the present disclosure. Those skilled in the art can make adjustments to the implementations as needed in order to adapt to specific application scenarios.

In the description of the embodiments in the present disclosure, it should be noted that, unless otherwise clearly specified and limited, meanings of terms "connected with" and "connected to" should be understood in a broad sense. For example, the connection may be a fixed connection, a removable connection, an integral connection, a mechanical connection, an electrical connection, a direct connection or an indirect connection through a medium. Those of ordinary skill in the art may understand specific meanings of the foregoing terms in the embodiments of the present disclosure based on a specific situation.

In the embodiments of the present disclosure, unless otherwise explicitly specified and limited, when it is described that a first feature is "above" or "below" a second feature, it indicates that the first and second features are in direct contact or the first and second features are in indirect contact through an intermediate feature. In addition, when it is described that the first feature is "over", "above" and "on" the second feature, it indicates that the first feature is directly or obliquely above the second feature, or simply indicates that an altitude of the first feature is higher than that of the second feature. When it is described that the first feature is "under", "below" or "beneath" the second feature, it indicates that the first feature is directly or obliquely under the second feature or simply indicates that an altitude of the first feature is lower than that of the second feature.

The present disclosure will be further described in detail below in conjunction with the drawings and specific embodiments.

As shown in FIGS. 1 to 4, an embodiment of the present disclosure provides a carpet. The carpet is machine washable, meaning it can be cleaned using a washing machine or other cleaning equipment. In this embodiment, the carpet includes carpet layer 1 and pad layer 2 located below the carpet layer 1. The pad layer 2 is laid on a floor, and the carpet layer 1 is laid on the pad layer 2. Specifically, the carpet layer 1 includes a bottom surface facing the pad layer 2 and a carpet surface opposite to and away from the pad layer 2. The pad layer 2 includes an upper surface and a lower surface. The upper surface faces the carpet layer 1, and the lower surface faces the floor. In this embodiment, the carpet is a double-layer structure, and there is no connection between the carpet layer 1 and the pad layer 2, such that carpet layer 1 can be disassembled, that is, the carpet layer 1 can be freely removed to machine wash the carpet layer 1 separately. In the embodiment of the present disclosure, the carpet is divided into the carpet layer 1 and the pad layer 2 that are detachable, effectively reducing a thickness of the carpet layer 1 and facilitating machine washing.

It is not difficult to understand that a size of the pad layer 2 is smaller than that of the carpet layer 1. Therefore, when the carpet layer 1 is laid on the pad layer 2, a surrounding edge of the carpet layer 1 protrudes from the pad layer 2 and makes contact with the floor or ground to reduce a height difference from the floor or ground to a top of the carpet layer 1 and prevent personnel from tripping and getting injured.

In this embodiment, the carpet layer 1 is a one-piece carpet, which is cut according to the size of the pad layer 2, with its shape adapted to the shape of the pad layer 2. The carpet layer 1 is made of a polyester fiber material or fabric material. The carpet layer 1 is machine washable as a whole. A surface of the carpet layer 1 can be provided with a waterproof layer. The waterproof layer is a polyurethane waterproof layer formed on a surface of the carpet, which can provide a splash-proof function in a short period of time, avoiding dirtying and wetting the carpet surface.

Figure 5:
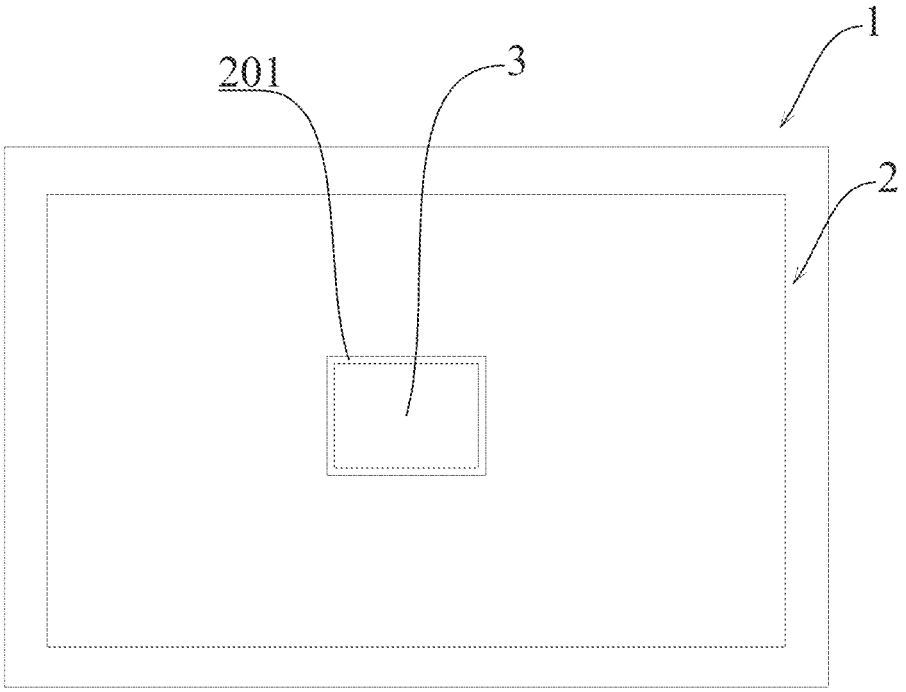
FIG. 5 is a structural schematic diagram of a carpet according to some other implementations of the present disclosure.

In some embodiments, the pad layer 2 can be a single piece or a combination of multiple pieces. When the pad layer 2 is a whole piece, as shown in FIG. 5, its shape is generally quadrilateral or roughly quadrilateral, but it can also be other shapes such as circular, trapezoidal, and elliptical. When the pad layer 2 is composed of multiple pad units 200 spliced together, the pad unit 200 is generally polygonal, such as quadrilateral and hexagon.

Figure 2:
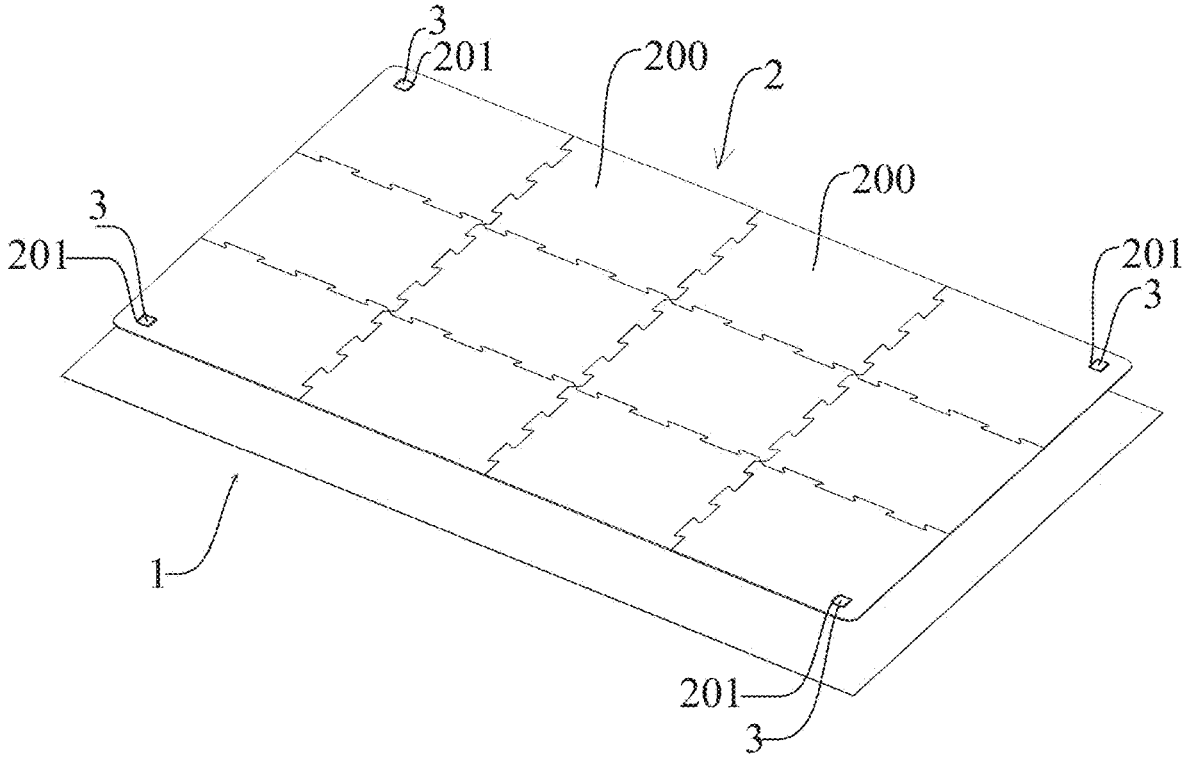
FIG. 2 is a back structural schematic diagram of the carpet according to some implementations of the present disclosure.
Figure 3:
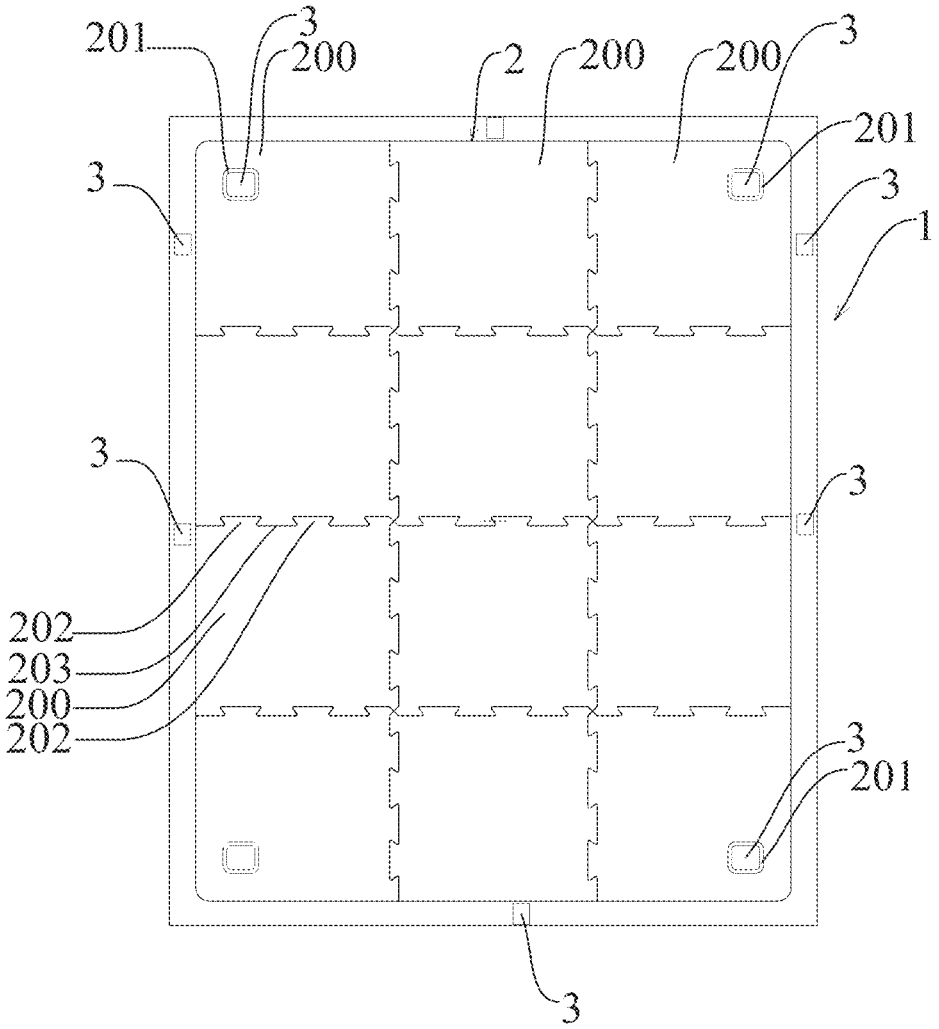
FIG. 3 is a bottom structural schematic diagram of the carpet according to some implementations of the present disclosure.
Figure 4:
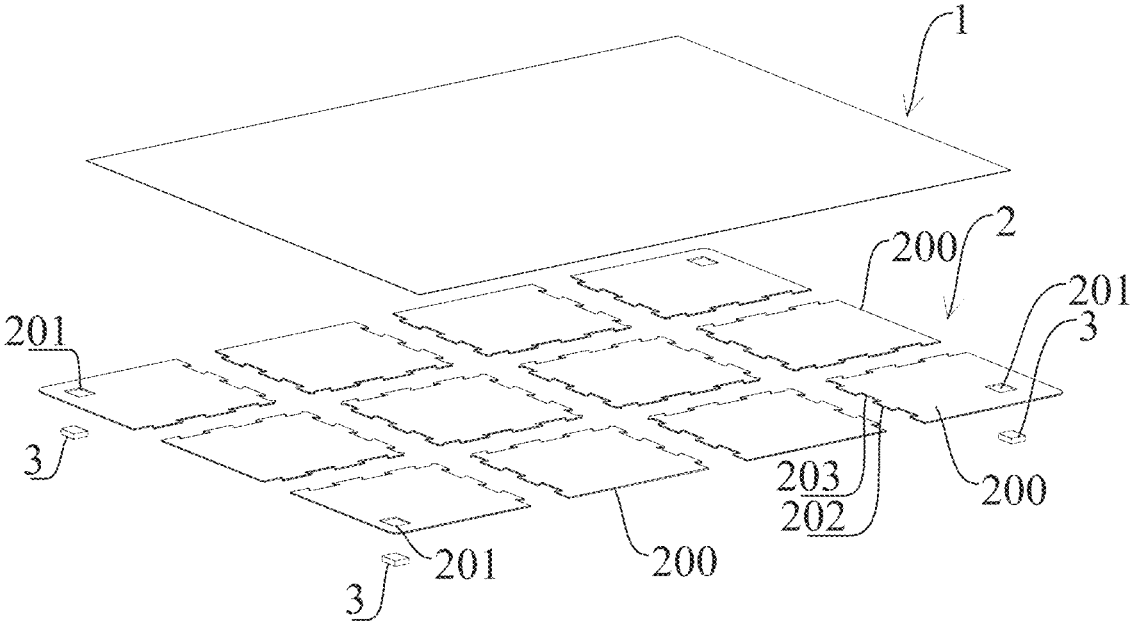
FIG. 4 is a mounting structural schematic diagram of the carpet according to some implementations of the present disclosure.

In this embodiment, as shown in FIGS. 2, 3, and 4, the pad layer 2 includes multiple quadrilateral pad units 200. The multiple pad units 200 are spliced together to form the pad layer 2. An edge of the pad unit 200 is connected to multiple spaced clamping protrusions 202. Clamping groove 203 for adaptively clamping the clamping protrusion 202 of another pad unit 200 is provided between each two adjacent clamping protrusions 202. To splice the pad units 200, the pad units 200 to be spliced are placed horizontally on the ground, and the clamping protrusions 202 and the clamping grooves 203 of each two adjacent pad units 200 are clamped to prevent the two adjacent pad units 200 from detaching in a transverse or longitudinal direction. In this embodiment, an outer side wall of the pad unit 200 located at an edge of the pad layer 2 may not be provided with the staggered clamping protrusions 202 and clamping grooves 203. A user can select an appropriate number of pad units 200 for splicing according to an indoor carpet area needed, and cut the size of the carpet layer 1 based on an area of the pad layer 2, such that an area of the carpet layer 1 matches that of the pad layer 2. Therefore, an appropriate number of pad units 200 can be selected for splicing according to the requirements of carpet size in different scenarios, thereby achieving good universality.

To lay the carpet, in order to facilitate accurate and convenient alignment between the carpet layer 1 and the pad layer 2, the carpet further includes at least one connection module 3. The connection module 3 is located below the carpet layer 1 and is connected to the carpet layer 1. It is not difficult to understand that the connection module 3 has weight and a certain thickness or height. When the carpet layer 1 or the pad layer 2 is displaced or tends to be displaced due to external force, the connection module 3 and the pad layer 2 are in close proximity to and against each other. When the carpet layer 1 or the pad layer 2 is subjected to external force and moves horizontally or tends to move, the connection module 3 abuts against the pad layer 2 to prevent horizontal displacement or misalignment of the carpet layer 1 and the pad layer 2.

In the above-mentioned embodiment, the external force may be force exerted by a person's foot on the carpet layer or the pad layer when the person walks on the carpet. Due to the external force, the carpet layer 1 or the pad layer 2 tends to move horizontally or is displaced horizontally. In this case, the connection module 3 and the pad layer 2 are in close proximity to and against each other, preventing further displacement of the carpet layer 1 and the pad layer 2. More specifically, when the carpet is laid, the pad layer 2 and the connection module 3 are in an initial state of coming into contact with each other. If there is external force acting, the carpet layer 1 and the pad layer 2 tend to move horizontally. At this point, the pad layer 2 and the connection module 3 abut against each other to prevent displacement. Alternatively, when the carpet is laid, the pad layer 2 and the connection module 3 are in an initial state of not coming into contact with each other. In this case, if there is external force acting, the carpet layer 1 and the pad layer 2 will be displaced horizontally. However, the connection module 3 plays a blocking role. The connection module 3 and the pad layer 2 are in close proximity to and against each other to prevent displacement.

Therefore, to lay the carpet, the pad layer 2 is first laid, then the connection module 3 is connected to the carpet layer 1, and the carpet layer 1 is laid. The connection module 3 connected below the carpet layer 1 is configured to prevent a horizontal displacement between the carpet layer 1 and the pad layer 2. That is, due to the mutual limit of the connection module 3 and the pad layer 2, the carpet layer 1 is prevented from displacing horizontally relative to the pad layer 2. Furthermore, the limit of the carpet layer 1 and the connection module 3 effectively prevents the horizontal displacement of the pad layer 2 relative to the carpet layer 1. Therefore, the carpet can prevent the horizontal displacement of the carpet layer 1 and the pad layer 2, thereby ensuring accurate, simple, and convenient alignment between the carpet layer 1 and the pad layer 2 during carpet laying.

In the above-mentioned embodiment, alternatively, to lay the carpet, the pad layer 2 is first laid, and the connection module 3 is placed on or connected to the floor. Then the carpet layer 1 is laid on the pad layer 2, and each connection module 3 is connected to the carpet layer 1. Finally, the position of the carpet layer 1 relative to the pad layer 2 is adjusted to achieve positioning alignment.

It can be understood that the connection module 3 is connected to the carpet layer 1, and the connection module 3 has a certain degree of hardness and weight. In this way, it can effectively prevent the edge of the carpet layer 1 from warping, wrinkling, etc., and improve the laying efficiency. In addition, due to the mutual limit of the connection module 3 and the pad layer 2, the horizontal movement of the carpet layer 1 is restricted, effectively avoiding the horizontal displacement of the carpet layer 1 due to force, and preventing the carpet layer 1 from detaching or deviating from the pad layer 2.

In the above-mentioned embodiment, a lower surface of the connection module 3 connected to the carpet layer 1 can be connected to the floor such that the carpet layer 1 is fixed relative to the position of the floor. Alternatively, the connection module may not be connected to the floor but rely on its own gravity to make contact with the floor, which can also make the carpet layer 1 fixed relative to the position of the floor. Alternatively, an upper surface of the connection module 3 is connected to the carpet layer 1, and the lower surface of the connection module 3 is provided as an anti-slip surface. The anti-slip surface is configured to increase friction between the connection module 3 and the floor, such that the carpet layer 2 is fixed relative to the position of the floor, thereby preventing the carpet layer 1 from being displaced and avoiding the carpet layer 1 from detaching or deviating from the pad layer 2. In addition, the carpet layer 1 and the pad layer 2 can be aligned accurately, thereby improving the carpet laying efficiency.

It is necessary to further improve the efficiency of carpet laying and ensure fast and accurate alignment between the carpet layer 1 and the pad layer 2 to avoid horizontal displacement of the carpet layer 1 and the pad layer 2. In this embodiment, as shown in FIGS. 2, 3, 4, 5, and 6, the pad layer 2 is provided with at least one limiting hole 201 that penetrates upper and lower surfaces of the pad layer 2. The connection module 3 is accommodated in the limiting hole 201. An upper end of the connection module 3 is connected to a bottom of the carpet layer 1, while a lower end of the connection module 3 is connected to the floor. In this way, to lay the carpet, the pad layer 2 is first laid, such that the connection module 3 is accommodated in the limiting hole 201 of the pad layer 2 and the lower end of the connection module 3 is connected to the floor. Then, the carpet layer 1 is laid, and the carpet layer 1 is connected to the upper end of the connection module 3. Therefore, with the limiting coordination between the connection module 3 and the limiting hole 201 of the pad layer 2, the horizontal/transverse displacement of the pad layer 2 is prevented when the carpet layer 1 is laid, thereby ensuring accurate, fast, simple, and convenient alignment between the carpet layer 1 and the pad layer 2, and improving the efficiency of carpet laying.

Furthermore, in the above-mentioned embodiment, the upper end of the connection module 3 is connected to the carpet layer 1, and the lower end of the connection module 3 is connected to the floor. Under the action of the connection module 3, the carpet layer 1 is fixed to the floor, preventing horizontal/transverse and longitudinal displacements between the carpet layer 1 and the pad layer 2. Therefore, due to the connection function of the connection module 3, the movement of the carpet layer 1 is restricted, and the carpet layer 1 maintains a fixed position relative to the floor. In this way, it can effectively prevent the displacement of the carpet layer 1 due to force, and prevent the carpet layer 1 from detaching or deviating from the pad layer 2. Due to the limiting coordination between the connection module 3 and the limiting hole 201 of the pad layer 2, it can prevent the pad layer 2 from experiencing significant horizontal/transverse displacement due to force. Meanwhile, due to the limit of the pad layer 2 and the limiting hole 201 of the pad layer 2, it further avoids horizontal/transverse displacement of the carpet layer 1 relative to the pad layer 2, effectively preventing the carpet layer 1 from detaching or deviating from the pad layer 2.

For example, as shown in FIG. 5, the carpet layer 1 is a single piece, and the pad layer 2 is a single piece. The pad layer 2 is provided with square limiting hole 201. The connection module 3 is square in shape, adapted to the shape of the limiting hole 201. The connection module 3 is accommodated in the limiting hole 201. The upper end of the connection module 3 is detachably connected to the carpet layer 1, and the lower end of the connection module 3 is detachably connected to the floor. The position, size, shape, etc. of the limiting hole 201 can be set according to actual needs. For example, regarding the position of the limiting hole 201, if the carpet has a small overall area, the position of the limiting hole 201 can be set at a center of the pad layer 2. If one side of the carpet is placed against a wall, the limiting hole 201 can be positioned on a side of the pad layer 2 away from the wall.

In this embodiment, multiple connection modules 3 are provided to better secure the carpet layer 1. There are multiple limiting holes 201 at the edge of the pad layer 2. Each limiting hole 201 is configured to accommodate the connection module 3. In this way, the multiple connection modules 3 are arranged along the edge of the pad layer 2. That is, the connection modules 3 are distributed along the edge of the carpet layer 1. The setting of the multiple connection modules 3 makes the carpet layer 1 more firmly fixed to the floor. In addition, the connection module 3 has a certain weight and hardness, which can improve the mechanical strength of the edge of the carpet layer 1, prevent or alleviate wrinkles and warping of the edge of the carpet layer 1.

Furthermore, at least one connection module 3 accommodated in the limiting hole 201 is located at a corner of the bottom of the carpet layer 1. That is, at least one of the connection modules 3 is connected to a corner of the bottom of the carpet layer 1, or a corner of the bottom of the carpet layer 1 is at least connected to one connection module 3 accommodated in the limiting hole 201 of the pad layer 2. Specifically, in this embodiment, the four corners of the bottom of the carpet layer 1 are respectively connected to one connection module 3, and the four connection modules 3 are respectively accommodated in four limiting holes 201 at the four corners of the pad layer 2. In this way, the carpet layer 1 and the pad layer 2 can be quickly aligned and horizontal displacement between the carpet layer 1 and the pad layer 2 can be effectively prevented.

For example, as shown in FIGS. 2 and 3, the carpet layer 1 is a single piece, while the pad layer 2 is composed of multiple pad units 200 spliced together. The limiting holes 201 are respectively located on the four pad units 200 located at the four corners of the pad layer 2. The four connection modules 3 are respectively accommodated in the four limiting holes 201 at the four corners of the pad layer 2. The upper ends of the four connection modules 3 are respectively connected to the four corners of the bottom of the carpet layer 1. In this way, the four corners of the carpet layer 1 are fixed to the floor through the connection modules 3, which firmly fix the carpet layer 1 and effectively prevent the four corners of the carpet layer 1 from warping, avoiding the risk of tripping.

In some embodiments, as shown in FIG. 3, at least one of the connection modules 3 is located at the edge of the bottom of the carpet layer 1 and on an outer side of the pad layer 2. It is not difficult to understand that in the actual mounting of the carpet, the manufacturer or merchant may appropriately provide a larger or additional number of connection modules 3. The connection module 3 is correspondingly accommodated in the limiting hole 201 of the pad layer 2. In addition, in order to further increase the firmness and stability of the connection between the carpet layer 1 and the floor, the user can also selectively or separately place an excess number of connection modules 3 at the edge of the bottom of the carpet layer 1 and on the outer side of the pad layer 2. In this way, the connection module 3 is directly connected to the carpet layer 1 and the floor without passing through the pad layer 2, thereby making the edge of the carpet layer 1 more firmly fixed, effectively preventing edge warping, and avoiding tripping risks.

In some embodiments, there are multiple connection modules 3 provided, and the multiple connection modules 3 are arranged at the edge of the bottom of the carpet layer 1 and on the outer side of the pad layer 2, which can be referred to in the implementations shown in FIGS. 13, 15, 17, and 21.

Furthermore, in this embodiment, there is a movement gap between the connection module 3 and an inner wall of the limiting hole 201. That is, the connection module 3 is accommodated in the limiting hole 201 but does not come into contact with the inner wall of the limiting hole 201. In other words, a size of the connection module 3 is smaller than a size of the limiting hole 201. In this way, the connection module 3 is easy to mount, reducing the difficulty of laying the carpet, facilitating the user to quickly lay the carpet, and also facilitating the adjustment of the horizontal position of the pad layer 2. In addition, the movement gap between the connection module 3 and the inner wall of the limiting hole 201 facilitates the user to disassemble the connection module 3.

Figure 7:
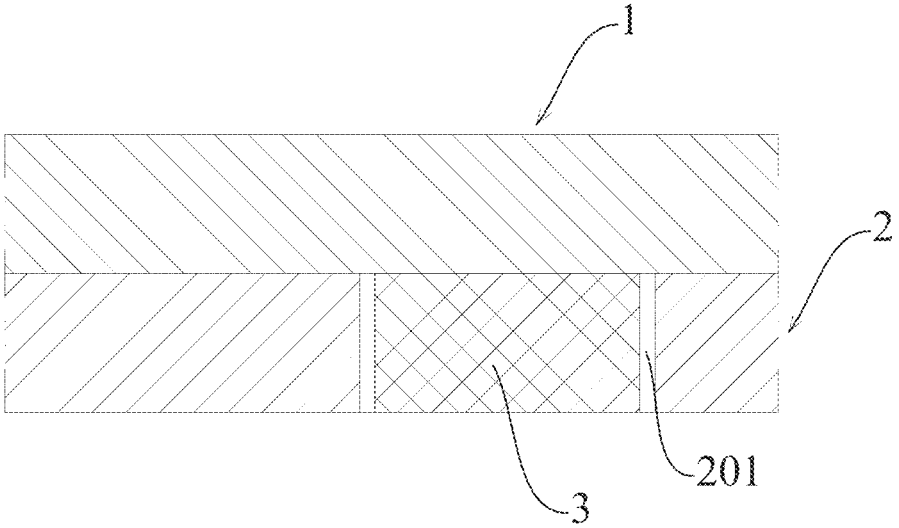
FIG. 7 is a mounting schematic diagram of a connection module of the carpet according to some implementations of the present disclosure.
Figure 8:
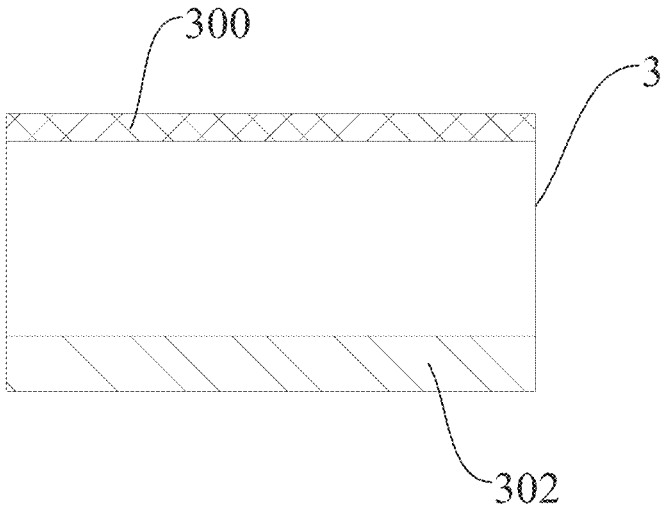
FIG. 8 is a sectional schematic diagram of the connection module of the carpet according to some implementations of the present disclosure.

In this embodiment, the upper end of the connection module 3 is detachably connected to the carpet layer 1. Specifically, as shown in FIGS. 7 and 8, a fabric surface layer is provided at the bottom of the carpet layer 1. An upper end surface of the connection module 3 is provided with hook&loop fastener surface 300. The hook&loop fastener surface 300 matches and adheres to the fabric surface at the bottom of the carpet layer 1. In this way, it is convenient to disassemble or fix the carpet layer 1 and the upper end of the connection module 3. In this embodiment, the fabric surface layer can be made of a material such as terry fabric, non-woven fabric, plush fabric, mesh fabric, cotton fabric layer, and suede fabric.

In other embodiments, the upper end of the connection module 3 is detachably connected to the carpet layer 1. Alternatively, the upper end surface of the connection module 3 is provided with a fabric surface layer, and a bottom surface of the carpet layer 1 is provided with a hook&loop fastener surface that matches and adheres to the fabric surface layer. For example, four corners of the bottom surface of the carpet layer 1 are connected to four hook&loop fastener surfaces. The four hook&loop fastener surfaces correspond to the four connection modules, respectively, and the upper end surface of the connection module is combined with and connected to the fabric surface layer that matches and adheres to the hook&loop fastener surface.

Figure 9:
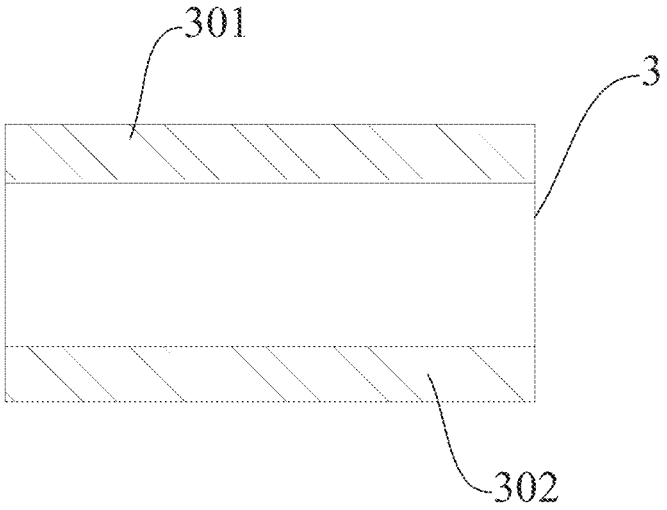
FIG. 9 is a schematic diagram of another embodiment of the connection module of the carpet according to some implementations of the present disclosure.

In other embodiments, the upper end of the connection module 3 is detachably connected to the carpet layer 1. Alternatively, the upper end surface of the connection module is provided with first adhesive flexible glue layer 301. As shown in FIG. 9, the first adhesive flexible glue layer 301 matches and adheres to the bottom surface of the carpet layer 1.

In other embodiments, the upper end of the connection module 3 is detachably connected to the carpet layer 1. Alternatively, the bottom surface of the carpet layer 1 is provided with a first adhesive flexible glue layer corresponding to the connection module 3. The first adhesive flexible glue layer matches and adheres to the upper end surface of the connection module.

In some embodiments, the connection module 3 is made of an adhesive flexible glue material, which means that the entire connection module 3 has adhesive properties and can match and adhere to the bottom surface of the carpet layer 1.

In other embodiments, the upper end of the connection module 3 is detachably connected to the carpet layer 1. Alternatively, a buckle can be provided between the upper end of the connection module and the carpet layer, and through the detachable buckle, the detachable connection between the upper end of the connection module and the carpet layer is achieved.

In some embodiments, the connection module 3 is made of a flexible material such as rubber and soft silicone, which are soft and have a certain degree of elasticity. Therefore, the connection module 3 will not affect the softness of the carpet layer 1.

In other embodiments, the connection module 3 can also be made of a hard material such as metal, hard plastic, and hard silicone. Due to the generally small thickness and small volume of the connection module, it will not affect the softness of the carpet layer 1.

In order to facilitate the disassembly and laying of the carpet and the mounting and disassembly of the connection module, in this embodiment, the lower end of the connection module 3 is detachably connected to the floor. The detachable connection is one of adhesive connection, vacuum adsorption connection, electrostatic adsorption connection, magnetic attraction connection, binding connection, concave-convex combination, and buckle connection. Below are detailed descriptions of Embodiments 1, 2, 3, 4, 5, 6, and 7 of the detachable connection between the connection module 3 and the floor.

Specifically, the detachable connection between the connection module 3 and the floor is achieved through adhesive connection, which includes the following implementations. In a first implementation, as shown in FIGS. 7, 8, and 9, the lower end surface of the connection module 3 is provided with second adhesive flexible glue layer 302 that matches and adheres to the floor. In this embodiment and the above-mentioned embodiments, the adhesive flexible glue layer has good adhesion and can be reused multiple times. For example, the adhesive flexible glue layer uses an adhesive tape made of a self-adhesive material, or a self-adhesive tape, a non-adhesive tape, or a double-sided tape, etc. After the adhesive flexible glue layer is removed from the floor, the adhesive flexible glue layer firmly re-adhere to the floor, thereby achieving the detachable connection between the lower end of the connection module 3 and the floor. In a second implementation, the connection module 3 is made of an adhesive flexible glue material and can adhere to the floor. That is, the entire connection module 3 has adhesion. The upper end of the connection module 3 can adhere to the bottom of the carpet layer 1, and the lower end of the connection module 3 can adhere to the floor. The adhesive flexible glue material can be hydrogel, self-adhesive silica gel, etc. In a third implementation, the connection module 3 is made of an adhesive material and adheres to the floor after absorbing water. That is, the connection module 3 is in a non-adhesive state under normal conditions and only produces adhesion when it comes into contact with water or absorbs water. The adhesive material can be made of a hydrophilic material such as superabsorbent resin, polyacrylamide, and glutinous starch. When the connection module 3 adheres to the floor, the connection module 3 first absorbs water to produce adhesion, and then adheres to the floor.

In a preferred embodiment of the present disclosure, the upper end surface of the connection module 3 is provided with hook&loop fastener surface 300, and a lower end surface of the connection module 3 is provided with second adhesive flexible glue layer 302. The hook&loop fastener surface 300, the connection module 3, and the second adhesive flexible glue layer 302 are formed as an integrated component. The bottom surface of the carpet layer 1 matches the hook&loop fastener surface 300 on the upper end surface of the connection module 3 is a fabric surface layer. The fabric surface layer can be provided locally or entirely on the bottom surface of the carpet layer 1, and the fabric surface layer can increase the friction between the carpet layer 1 and the pad layer 2, avoiding the displacement of the carpet layer 1 due to force. The second adhesive flexible glue layer 302 on the lower end surface of the connection module 3 adheres to the floor.

Figure 11:
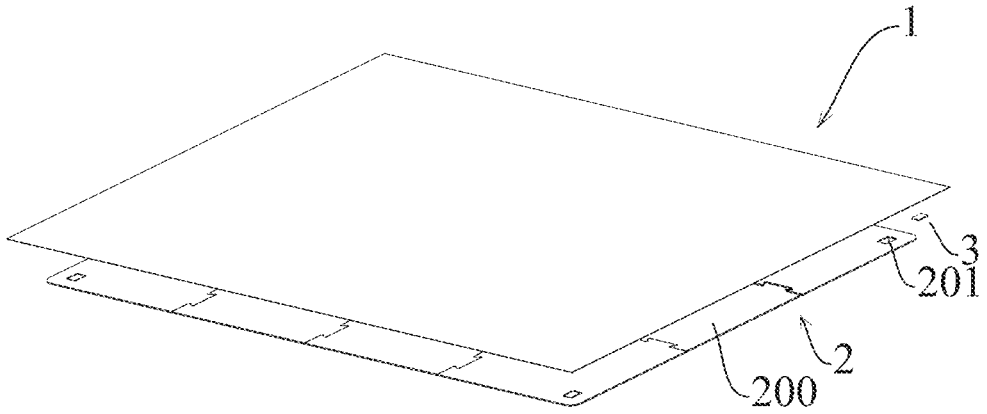
FIG. 11 is a structural schematic diagram of Embodiment 1 in which the connection module is connected to a floor according to some implementations of the present disclosure.
Figure 12:
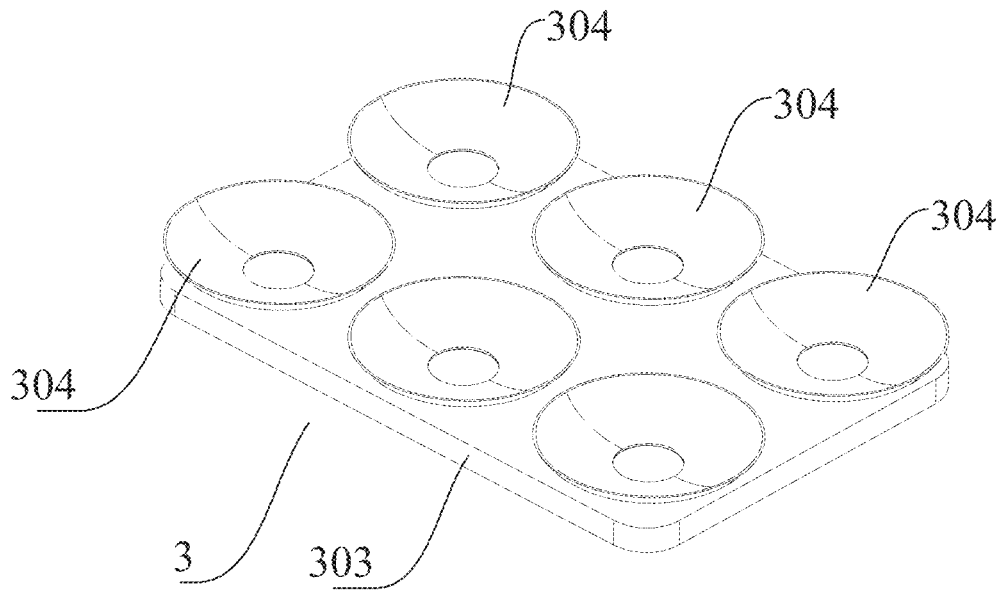
FIG. 12 is a structural schematic diagram of the connection module in Embodiment 1 in which the connection module is connected to the floor according to some implementations of the present disclosure.

The detachable connection between the connection module 3 and the floor is achieved through a vacuum adsorption connection method, which includes the following implementations. In a first implementation, the connection module 3 is a suction cup connected to the carpet layer 1 and vacuum adsorbed to the floor. That is, the bottom of the carpet layer 1 is connected to multiple suction cups. The suction cup is located inside or outside the limiting hole 201 of the pad layer 2, and the suction cup is vacuum adsorbed to the floor. In a second implementation, as shown in FIGS. 11 and 12 of Embodiment 1, the connection module 3 is connection plate 303 connected to the carpet layer 1, and the connection plate 303 is connected to multiple suction cups 304 that is vacuum adsorbed to the floor. In this implementation, the connection module 3 is located in the limiting hole 201 of the pad layer 2. That is, the connection plate 303 of the connection module 3 is accommodated in the limiting hole 201 of the pad layer 2. An upper end surface or a top surface of the connection plate 303 is connected to the bottom of the carpet layer 1, and the suction cup 304 at the bottom of the connection plate 303 is connected to the floor through vacuum adsorption. In a third implementation, the lower end surface of the connection module 3 is provided with an adsorbing part made of an adsorbable material. The material of the adsorbing part is made from acrylic resin as a raw material in a related art. The surface of the material itself includes multiple pores that are not visible to the naked eye. When pressed, the air inside the pores is released, forming a structure similar to a vacuum suction cup, which adsorbs onto the floor.

Figure 13:
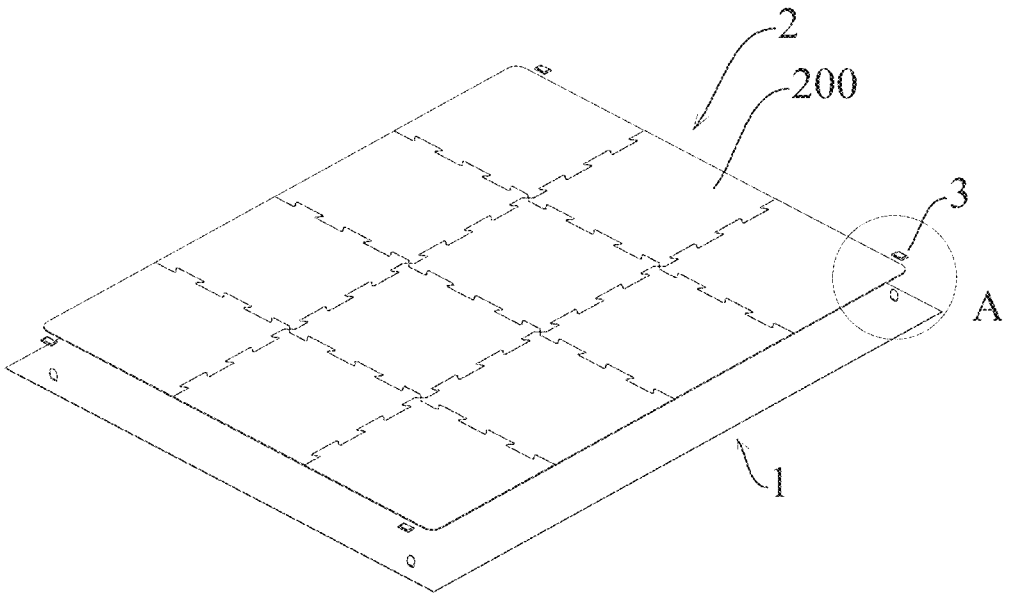
FIG. 13 is a structural schematic diagram of Embodiment 2 in which the connection module is connected to a floor according to some implementations of the present disclosure.
Figure 14:
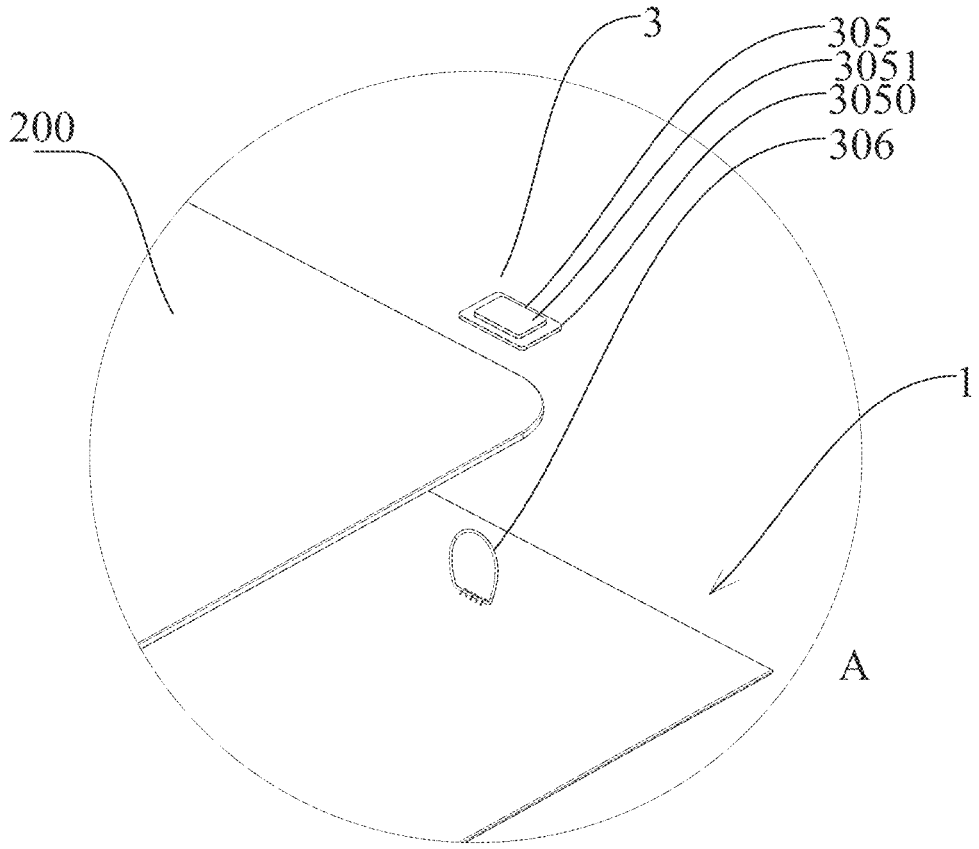
FIG. 14 is an enlarged view of A shown in FIG. 13.
Figure 15:
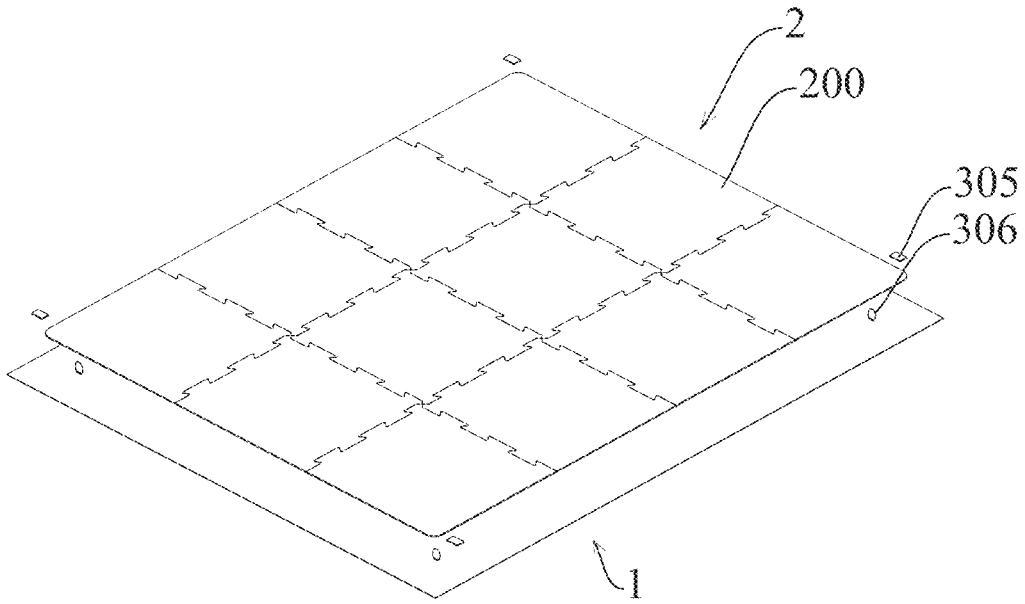
FIG. 15 is a structural schematic diagram of Embodiment 3 in which the connection module is connected to a floor according to some implementations of the present disclosure.
Figure 16:
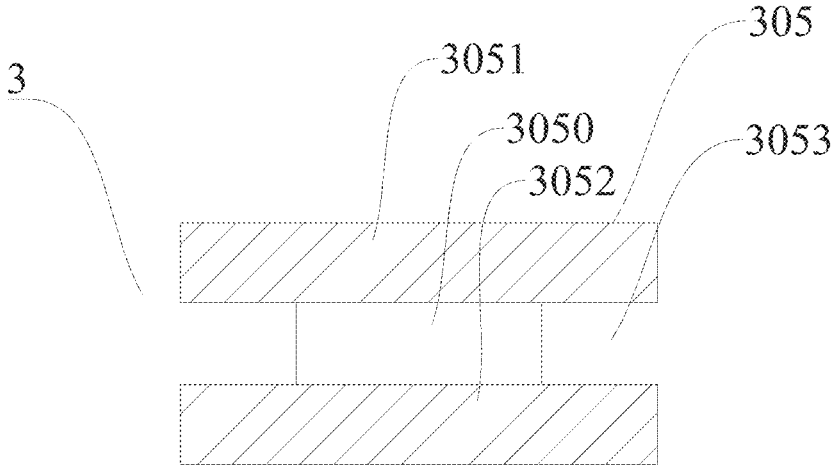
FIG. 16 is a structural schematic diagram of the connection module in Embodiment 3 in which the connection module is connected to the floor according to some implementations of the present disclosure.

The detachable connection between the connection module 3 and the floor is achieved through a binding connection method, including the following implementations. The connection module 3 includes positioning element 305 detachably connected to the floor and rope 306 connected to the carpet layer. The rope 306 is connected to the positioning element 305. Specifically, as shown in FIGS. 13 and 14 of Embodiment 2, the positioning element 305 includes first plate 3050 connected to the floor and second plate 3051 connected to the first plate 3050. A size of the second plate 3051 is larger than a size of the first plate 3050, such that after the first plate 3050 is connected to the floor, a connection part for connecting the rope 306 is formed between four sides of the first plate 3050 and a bottom of the second plate 3051. The rope 306 is in a closed ring shape. During connection, the rope 306 is simply attached to the connection part. The second plate 3051 serves to prevent the rope 306 from detaching from the connection part. Alternatively, in another implementation, as shown in FIGS. 15 and 16 of Embodiment 3, the positioning element 305 includes second plate 3051, first plate 3050, and third plate 3052 stacked and connected in sequence along a thickness direction. A size of the first plate 3050 located in a middle is smaller than a size of the second plate 3051 and the third plate 3052, forming annular connection groove 3053 between the second plate 3051 and the third plate 3052. The third plate 3052 is connected to the floor. The rope 306 at the bottom of the carpet layer 1 is fitted onto the connection groove 3053 through the second plate 3051, completing the mounting of the connection module 3 with the carpet layer.

Figure 17:
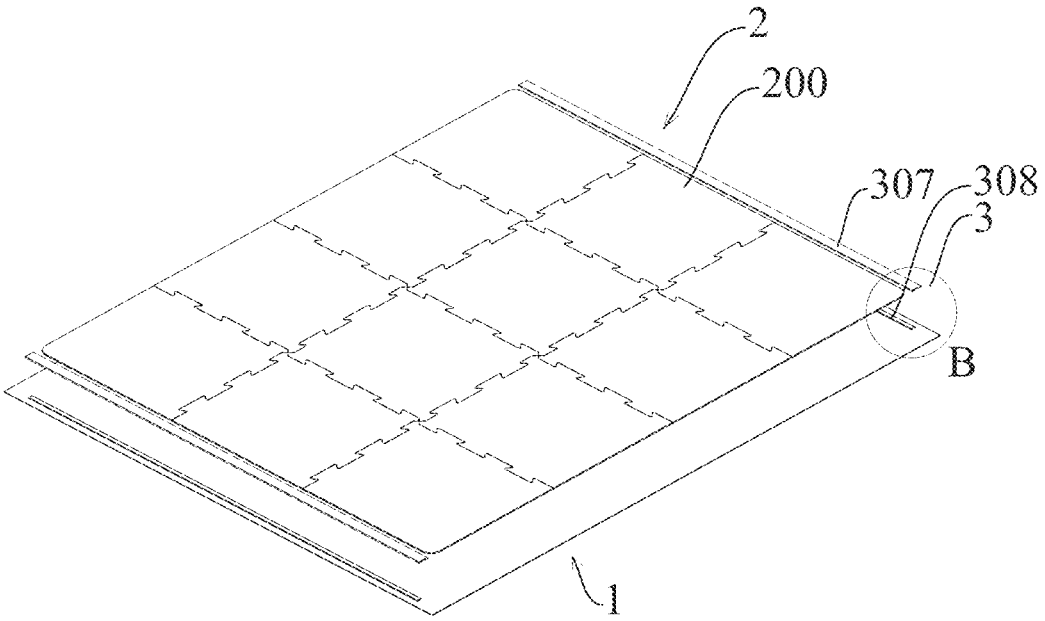
FIG. 17 is a structural schematic diagram of Embodiment 4 in which the connection module is connected to a floor according to some implementations of the present disclosure.
Figure 18:
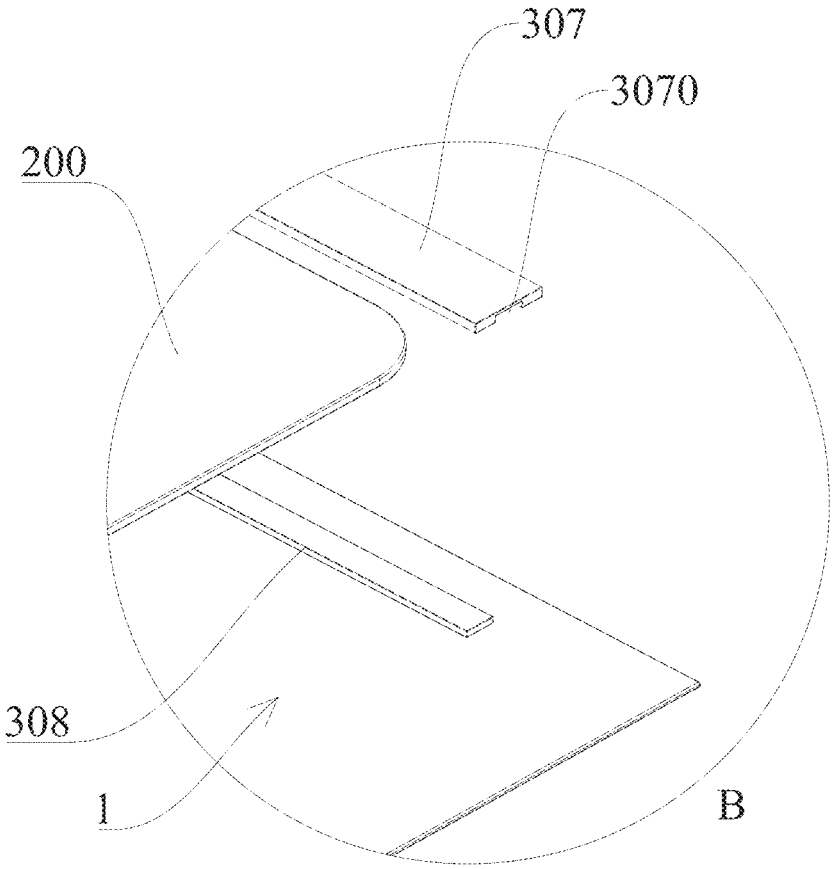
FIG. 18 is an enlarged view of B shown in FIG. 17.

The detachable connection between the connection module 3 and the floor is achieved through a concave-convex combination method, including the following implementations. As shown in FIGS. 17 and 18 of Embodiment 4, the connection module 3 includes first positioning member 307 connected to the floor and second positioning member 308 connected to the carpet layer 1. The first positioning member 307 and the second positioning member 308 are combined through a concave-convex structure. Specifically, the first positioning member 307 is provided with groove 3070 on a surface facing the carpet layer 1. The groove 3070 is adapted to the second positioning member 308 in terms of width and length. To lay the carpet layer 1, the second positioning member 308 at the bottom of the carpet layer 1 is clamped into the groove 3070 of the first positioning member 307. In this implementation, the connection module 3 is located on the outer side of the edge of the pad layer 2. In the above implementation, the concave-convex structure combination is also known as mortise and tenon connection, complementary structure combination, etc. After the first positioning member 307 and the second positioning member 308 are combined, their horizontal movement is restricted.

Figure 19:
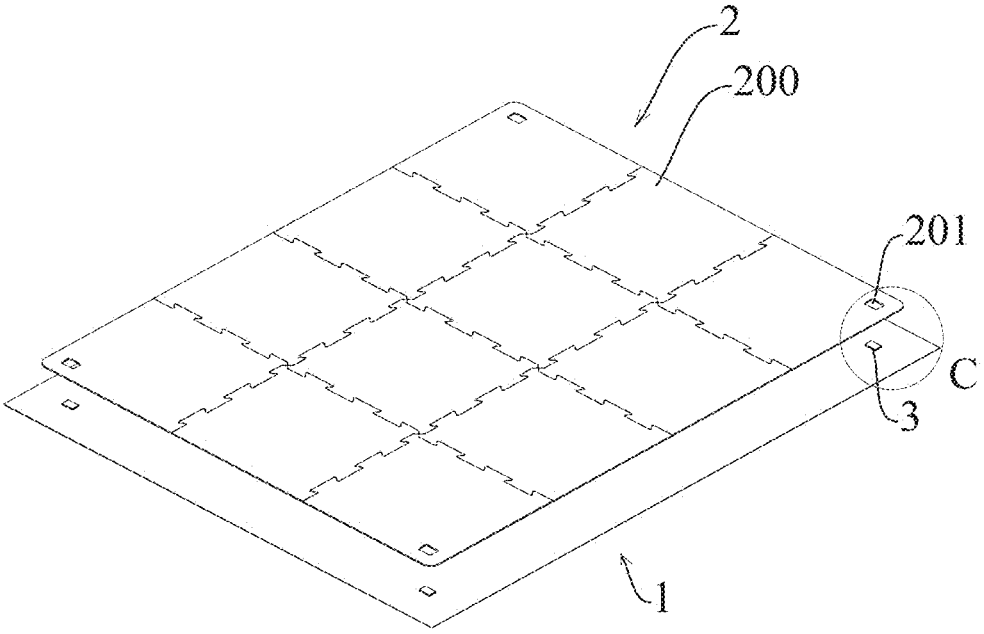
FIG. 19 is a structural schematic diagram of Embodiment 5 in which the connection module is connected to a floor according to some implementations of the present disclosure.
Figure 20:
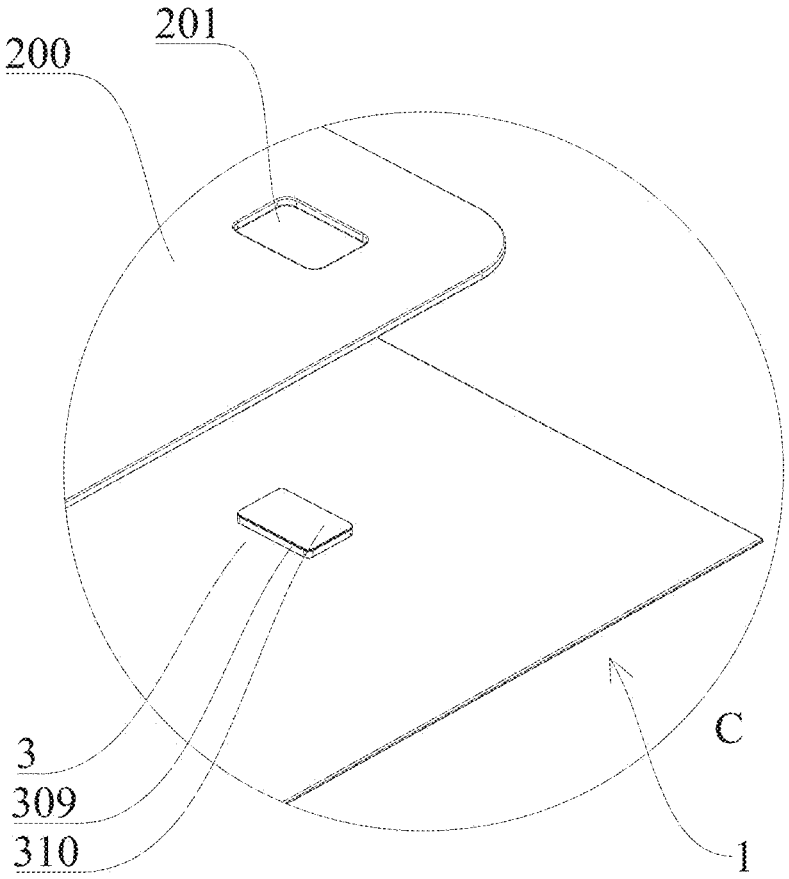
FIG. 20 is an enlarged view of C shown in FIG. 19.

The detachable connection between the connection module 3 and the floor is achieved through an electrostatic adsorption connection method, including the following implementations. As shown in FIGS. 19 and 20 of Embodiment 5, the connection module 3 is connection element 309 connected to the carpet layer 1, and the connection element 309 is connected to electrostatic sticker 310 that is electrostatically adsorbed to the floor. The electrostatic sticker 310 can be an electrostatic film made of thermoplastic polyurethane (TPU) or an electrostatic film made of carbon based resin, and is connected to the floor based on the principle of electrostatic adsorption.

Figure 21:
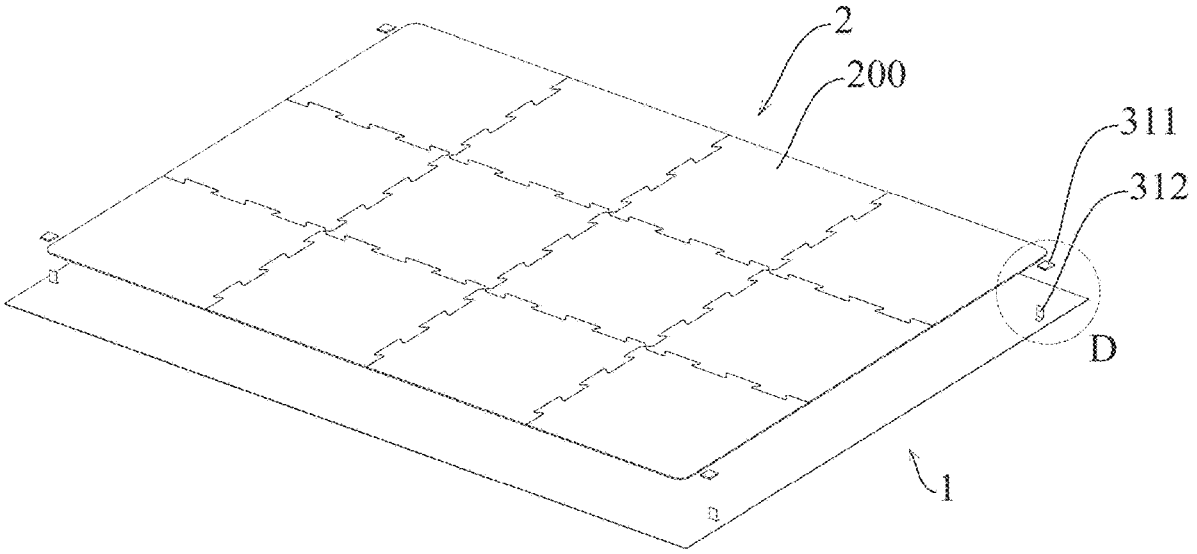
FIG. 21 is a structural schematic diagram of Embodiment 6 in which the connection module is connected to a floor according to some implementations of the present disclosure.
Figure 22:
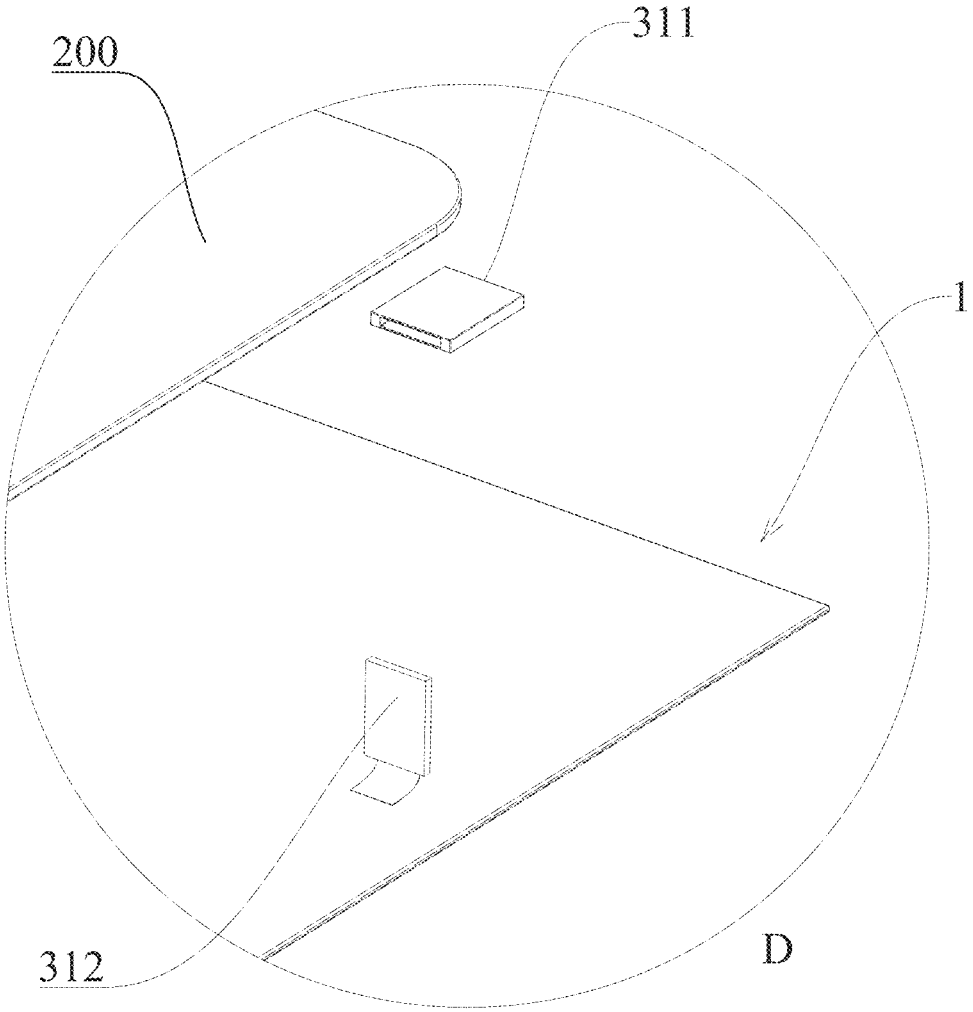
FIG. 22 is an enlarged view of D shown in FIG. 21.

The detachable connection between the connection module 3 and the floor is achieved through a buckle connection method, including the following implementations. As shown in FIGS. 21 and 22 of Embodiment 6, the connection module 3 includes first buckle 311 connected to the floor and second buckle 312 connected to the carpet layer 1. The first buckle 311 and the second buckle 312 match and form an insertion connection. In this implementation, the first buckle 311 and the second buckle 312 are snap buckles that match and form an insertion connection. The first buckle 311 connected to the floor is located on the outer side of the edge of the pad layer 2.

Figure 23:
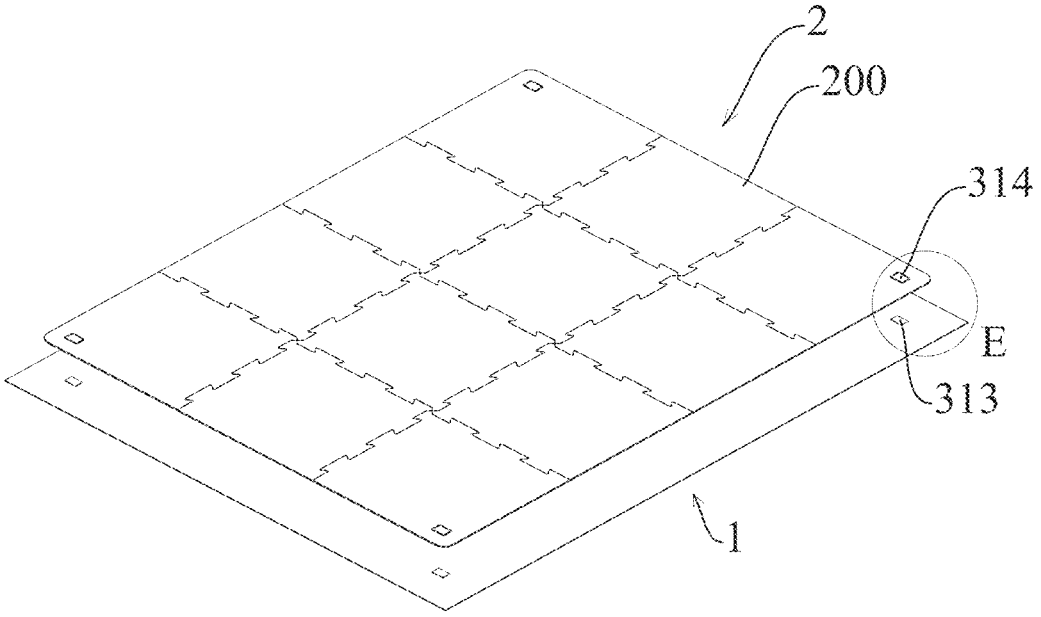
FIG. 23 is a structural schematic diagram of Embodiment 7 in which the connection module is connected to a floor according to some implementations of the present disclosure.
Figure 24:
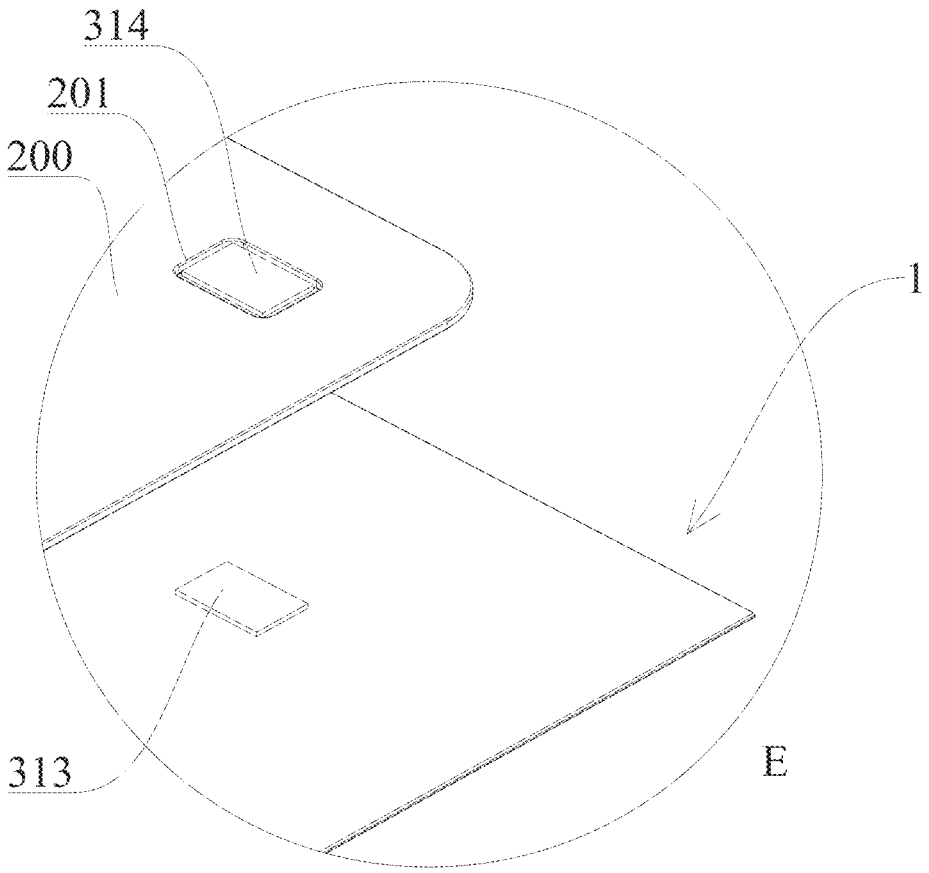
FIG. 24 is an enlarged view of E shown in FIG. 23.

The detachable connection between the connection module 3 and the floor is achieved through a magnetic attraction connection method, including the following implementations. As shown in FIGS. 23 and 24 of Embodiment 7, the connection module 3 includes first magnetic plate 313 connected to the carpet layer 1 and second magnetic plate 314 connected to the floor. The first magnetic plate 313 and the second magnetic plate 314 form a magnetic attraction connection. In this implementation, both magnetic plates have magnetism, or at least one magnetic plate has magnetism. The connection module 3 is detachably connected to the floor through magnetic attraction connection.

It is not difficult to understand that in the implementations of the detachable connection between the lower end of the connection module 3 and the floor, the connection module 3 is detachably connected to the floor as a whole, or the connection module 3 is detachably connected to the floor partially. Either of the methods can achieve convenient disassembly and assembly of the carpet layer 1, as well as easy alignment of the carpet during laying.

Figure 6:
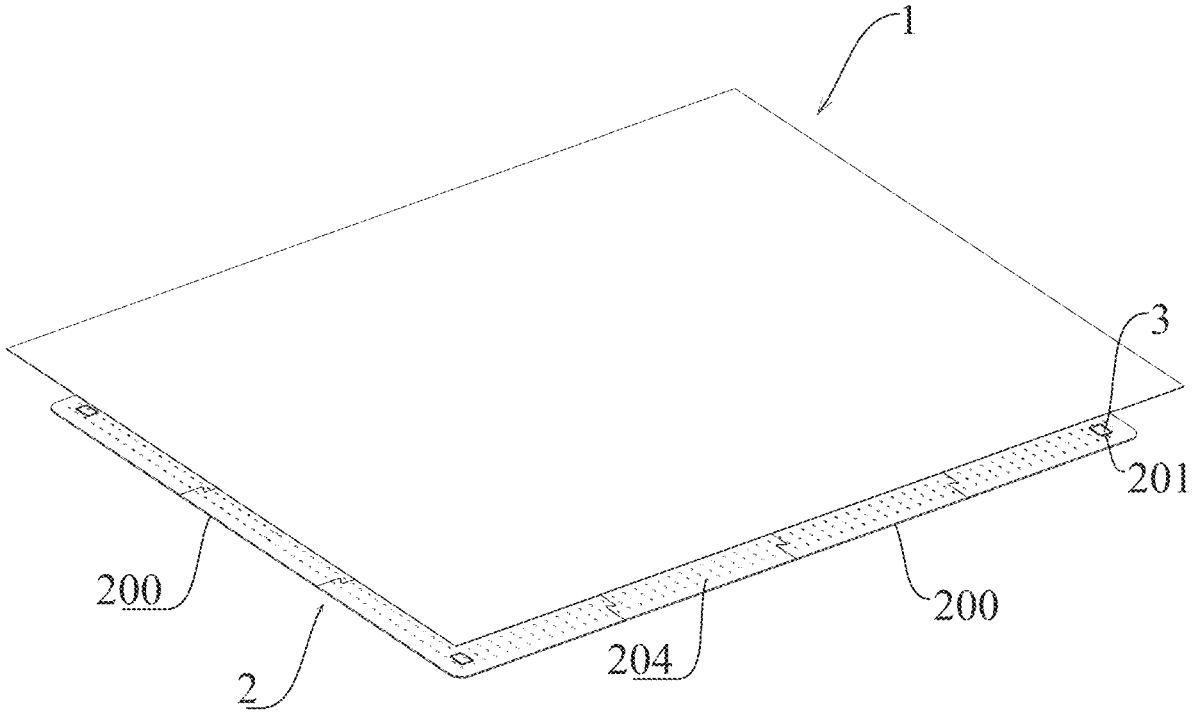
FIG. 6 is an assembly structural schematic diagram of the carpet according to some implementations of the present disclosure.
Figure 10:
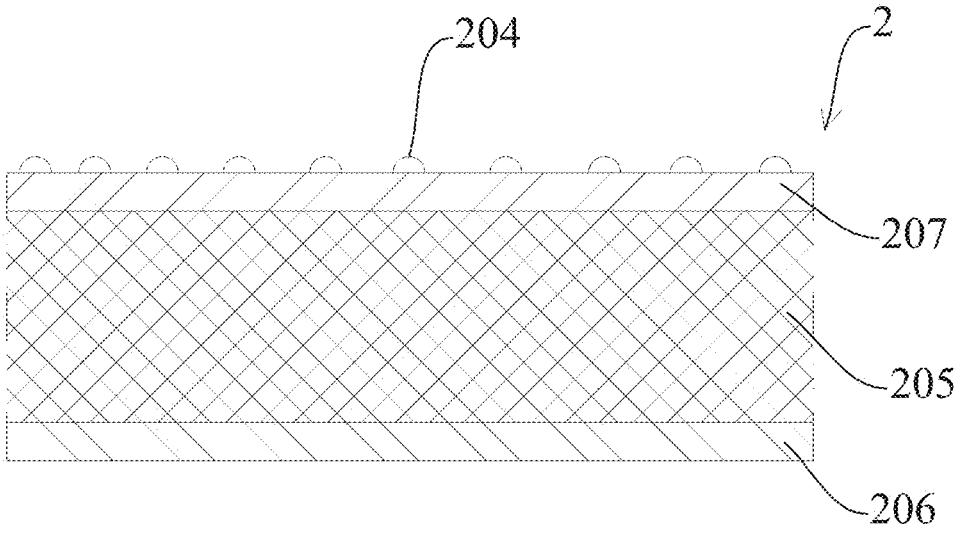
FIG. 10 is a sectional schematic diagram of a pad layer of the carpet according to some implementations of the present disclosure.

In some embodiments, as shown in FIGS. 6 and 10, a top surface of the pad layer 2 is uniformly covered with anti-slip protrusions 204 to increase a friction between the pad layer 2 and the carpet layer 1, preventing them from sliding and dislocating relative to each other. The anti-slip protrusions 204 are multiple raised anti-slip protrusions 204 formed by spot molding on the top surface of the pad layer 2. Of course, in other embodiments, the spot-shaped anti-slip protrusion 204 can also be planar or lumpy anti-slip protrusion 204.

In the embodiment of the present disclosure, the pad layer 2 has anti-slip properties to prevent an uneven carpet surface and the risk of tripping the user when the user walks. The pad layer 2 is shown in FIG. 10. The pad layer 2 includes base layer 205, first anti-slip layer 206 located below the base layer 205, and second anti-slip layer 207 located above the base layer 205. The base layer 205, the first anti-slip layer 206, and the second anti-slip layer 207 are combined together to form the pad layer 2. The matching of the pad layer 2 and the carpet layer 1 gives the carpet good fatigue resistance and increases the comfort of stepping. Meanwhile, the bottom of the pad layer 2 is subjected to anti-slip treatment to avoid the risk of decreased anti-slip performance of the pad in humid environments. The second anti-slip layer 207 includes multiple anti-slip protrusions 204 evenly distributed on the base layer 205.

In the above-mentioned embodiments, it is not difficult to understand that in order to improve the comfort of stepping on the carpet, the pad layer 2 is made of a soft elastic material. At least one of the base layer 205, the first anti-slip layer 206, and the second anti-slip layer 207 of the pad layer 2 is made of the soft elastic material. The soft elastic material is a material in the prior art, including but not limited to ethylene vinyl acetate (EVA), thermoplastic rubber (TPR), thermoplastic elastomer (TPE), and polyvinyl chloride (PVC), etc.

It should be noted that in the description of the embodiments in the present disclosure, terms such as "inner" and "outer" indicate orientation or position relationships based on the drawings. They are merely intended to facilitate description, rather than to indicate or imply that the mentioned device or assemblies must have a specific orientation and must be constructed and operated in a specific orientation. Therefore, these terms should not be construed as a limitation to the present disclosure.

In the description of the present disclosure, the description with reference to the terms "one embodiment", "some embodiments", "in this embodiment", "specific examples", or "some examples" means that specific features, mechanisms, materials, or characteristics described in combination with the embodiments or examples are included in at least one embodiment or example of the present disclosure. In this specification, the schematic expression of the above terms is not necessarily directed to the same embodiment or example. Moreover, the specific features, mechanisms, materials, or characteristics described may be combined in a suitable manner in any one or more embodiments or examples. In addition, those skilled in the art may combine different embodiments or examples described in this specification and characteristics of the different embodiments or examples without any contradiction.

The foregoing descriptions are merely specific implementations of the present disclosure, but are not intended to limit the protection scope of the present disclosure. Any variation or replacement readily figured out by a person skilled in the art within the technical scope disclosed in the present disclosure shall fall within the protection scope of this application. Therefore, the protection scope of the present disclosure shall be subject to the protection scope of the claims.

What is claimed is:

1. A carpet, comprising:

a pad layer, laid on a floor;

a carpet layer, detachably laid on the pad layer; and at least one connection module connected to the carpet layer and located between the carpet layer and the floor, wherein the at least one connection module passes vertically through the pad layer to contact the floor, wherein when the carpet layer or the pad layer is displaced or tends to be displaced due to external force, the at least one connection module and the pad layer are in close proximity to and against each other, wherein a lower surface of each of the at least one connection module does not extend beyond a lower surface of the pad layer.

2. The carpet according to claim 1, wherein each of the at least one connection module is detachably connected to the floor; and a detachable connection is one of adhesive connection, vacuum adsorption connection, electrostatic adsorption connection, magnetic attraction connection, binding connection, concave-convex combination, and buckle connection.

3. The carpet according to claim 2, wherein a lower end of each of the at least one connection module is provided with an adhesive flexible glue layer, the adhesive flexible glue layer adheres to the floor; or each of the at least one connection module is made of an adhesive flexible glue material; or each of the at least one connection module is made of an adhesive material and adheres to the floor after absorbing water.

4. The carpet according to claim 2, wherein each of the at least one connection module is a suction cup connected to the carpet layer and vacuum adsorbed to the floor; or each of the at least one connection module is a connection plate connected to the carpet layer and connected to a suction cup, wherein the suction cup is vacuum adsorbed to the floor; or a lower end surface of each of the at least one connection module is provided with an adsorbing part made of an adsorbable material.

5. The carpet according to claim 2, wherein each of the at least one connection module is a connection element connected to the carpet layer; and the connection element is connected to an electrostatic sticker electrostatically adsorbed to the floor.

6. The carpet according to claim 2, wherein each of the at least one connection module comprises a first magnetic plate connected to the carpet layer and a second magnetic plate connected to the floor; and the first magnetic plate and the second magnetic plate form a magnetic attraction connection.

7. The carpet according to claim 2, wherein each of the at least one connection module comprises a positioning element connected to the floor and a rope connected to the carpet layer; and the rope is connected to the positioning element.

8. The carpet according to claim 2, wherein each of the at least one connection module comprises a first positioning member connected to the floor and a second positioning member connected to the carpet layer; and the first positioning member and the second positioning member are combined through a concave-convex structure.

9. The carpet according to claim 2, wherein each of the at least one connection module comprises a first buckle connected to the floor and a second buckle connected to the carpet layer; and the first buckle and the second buckle match and form an insertion connection.

10. The carpet according to claim 1, wherein each of the at least one connection module is detachably connected to the carpet layer.

11. The carpet according to claim 10, wherein an upper end surface of each of the at least one connection module is provided with a hook&loop fastener surface, and a fabric surface layer matching and adhering to the hook&loop fastener surface is provided at a bottom surface of the carpet layer; or the upper end surface of each of the at least one connection module is provided with a fabric surface layer, and a hook&loop fastener surface matching and adhering to the fabric surface layer is provided at the bottom surface of the carpet layer; or the upper end surface of each of the at least one connection module is provided with an adhesive flexible glue layer, and the adhesive flexible glue layer matches and adheres to the bottom surface of the carpet layer; or the bottom surface of the carpet layer is provided with an adhesive flexible glue layer corresponding to each of the at least one connection module; and the adhesive flexible glue layer matches and adheres to the upper end surface of each of the at least one connection module.

12. The carpet according to claim 1, wherein the pad layer comprises a base layer, a first anti-slip layer located below the base layer, and a second anti-slip layer located above the base layer; and the base layer, the first anti-slip layer, and the second anti-slip layer are combined together to form the pad layer.

13. The carpet according to claim 12, wherein the second anti-slip layer comprises a plurality of anti-slip protrusions evenly distributed on the base layer.

14. The carpet according to claim 1, wherein the pad layer is a one-piece pad; or the pad layer comprises a plurality of pad units; the plurality of pad units are spliced together to form the pad layer; the plurality of pad units are polygonal; a surrounding edge of the pad unit is provided with a plurality of spaced clamping protrusions; and a clamping groove for adaptively clamping the clamping protrusion of another pad unit is provided between each two adjacent clamping protrusions.

15. A carpet, comprising:

a pad layer, laid on a floor;

a carpet layer, detachably laid on the pad layer; and at least one connection module located between the carpet layer and the floor, wherein each of the at least one connection module passes vertically through the pad layer to contact the floor, wherein each of the at least one connection module comprises an upper surface connected to the carpet layer and a lower surface detachably connected to the floor, wherein a lower surface of each of the at least one connection module does not extend beyond a lower surface of the pad layer.

16. A carpet, comprising:

a pad layer, laid on a floor;

a carpet layer, detachably laid on the pad layer; and at least one connection module, located between the carpet layer and the floor, wherein each of the at least one connection module passes vertically through the pad layer to contact the floor, wherein each of the at least one connection module comprises an upper surface connected to the carpet layer and a lower surface being an anti-slip surface to increase friction between each of the at least one connection module and the floor, wherein a lower surface of each of the at least one connection module does not extend beyond a lower surface of the pad layer.

17. The carpet according to claim 1, wherein the at least one connection module is configured to pass vertically through the pad layer to contact the floor by extending through a portion of the pad layer or extending beyond outer edges of the pad layer.

18. The carpet according to claim 17, wherein the pad layer is provided with a set of limiting holes penetrating upper and lower surfaces of the pad layer, and the set of limiting holes is configured to accommodate the at least one connection module in a one-to-one correspondence.

19. The carpet according to claim 18, further comprising a movement gap between the at least one connection module and inner walls of the set of limiting holes.

20. The carpet according to claim 18, wherein:

each of the set of limiting holes is provided at an edge of the pad layer.

21. The carpet according to claim 20, wherein at least one of the at least one connection module is located at a corner of a bottom of the carpet layer.

22. The carpet according to claim 20, wherein at least one of the at least one connection module is located at an edge of a bottom of the carpet layer and on an outer side of the pad layer.

23. The carpet according to claim 17, wherein each of the at least one connection module is arranged at an edge of a bottom of the carpet layer and on an outer side of the pad layer.

* * * * *